US005451171A

United States Patent [19]

Dickie

[11] Patent Number: 5,451,171

[45] Date of Patent: Sep. 19, 1995

[54] ELECTRIC PLUG WITH REMOTE STRAIN RELIEF

[75] Inventor: Robert G. Dickie, Newmarket, Canada

[73] Assignee: Raige Manufacturing Inc., King City, Canada

[21] Appl. No.: 226,592

[22] Filed: Apr. 11, 1994

[51] Int. Cl.[6] ..... H01R 13/56

[52] U.S. Cl. ..... 439/447

[58] Field of Search ..... 439/445, 447

[56] References Cited

FOREIGN PATENT DOCUMENTS 3821017 1/1989 Germany ..... 439/447

*Primary Examiner*—Eugene F. Desmond

[57] ABSTRACT

An electric plug with a remote strain relief sleeve displaced along the electric cord from the plug body and connected to the plug body by a pair of rails attached to the plug body and the strain relief sleeve. The rails include opposing and alternating V-shaped grooves to provide flexibility. A tough, flexible insert molded within the rails adds strength without taking away flexibility. An arc in the cord between the plug body and the strain relief sleeve provides a force to bend the cord near the plug head while at the same time provide some slack to take up slippage of the copper wires within the cord.

4 Claims, 1 Drawing Sheet

FIG. 1
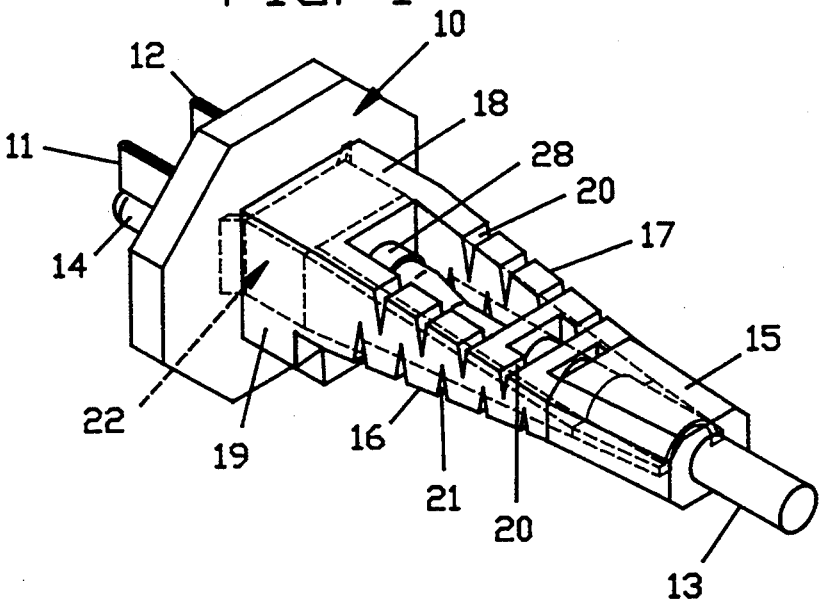
FIG. 2
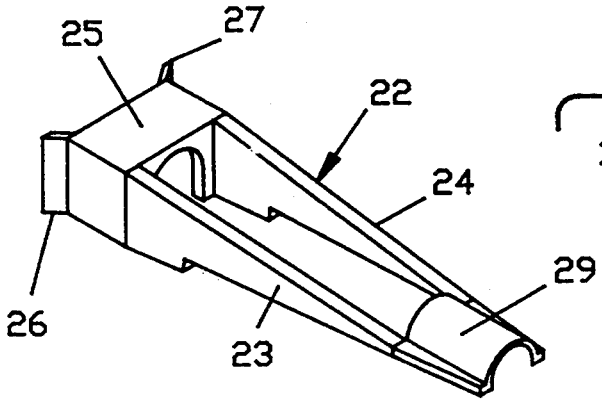
FIG. 3
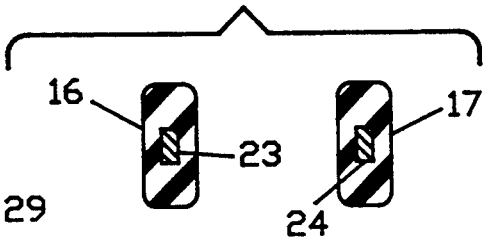
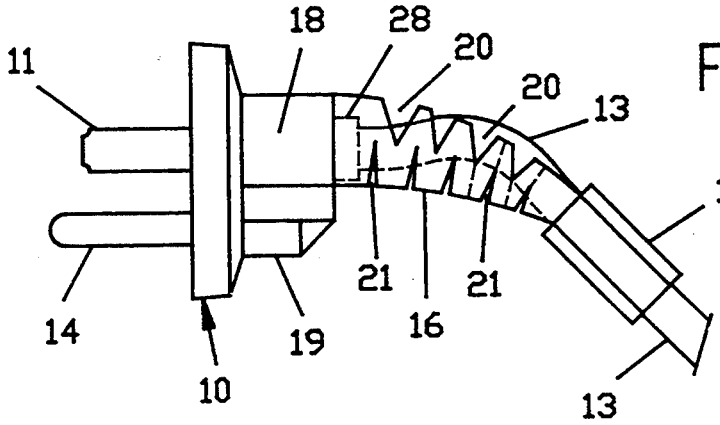
FIG. 4

ELECTRIC PLUG WITH REMOTE STRAIN RELIEF

TECHNICAL FIELD

This invention relates to electric plugs for electrical cords and, more particularly to strain relief for such plugs.

BACKGROUND OF THE INVENTION

Electrical plugs for extension cords, particularly power cords used for appliances and power tools, are often removed from the outlet by pulling on some part of the cord rather than by grasping and pulling on the plug itself. The result is that the wire cord can be pulled away from the plug body, causing the removal force to be exerted on the copper wires or the attachment of the copper wires to the power blades of the plug. This force can damage the wires, the blades or the attachement of the two, and possibly expose live wires and cause an electric shock hazard.

A common way to address the problem of excessive forces being exerted on the copper wires or power blades is to mold a strain relief sleeve into the back end of the plug body, and pass the electric wires through the center of the sleeve. The sleeve increases the area of contact between the electric wire jacket and the molded plug and sleeve. This increase in contact area, in turn, reduces the force exerted on the copper wires themselves as well as on the blade connections. In order to accomplish the necessary degree of strain relief, however, the strain relief sleeve must be sufficiently long to assure an adequate contact area. Such a long strain relief sleeve renders the exit from the plug head relatively inflexible, causing the sleeve and cord to extend significantly out from the wall outlet. Since the center of gravity of the plug assembly is significantly displaced from the wall, a torsional force is created on the plug, causing the power blades to tend to pull out of the outlet slots, disconnecting the appliance or partially exposing the live power blades.

SUMMARY OF THE INVENTION

In accordance with the illustrative embodiment of the present invention, the strain relief assembly for an electric plug is attached directly to the plug head, but the strain relief sleeve is remotely attached to the electrical cord. More particularly, the electrical cord is allowed to exit from the plug body without strain relief, thus allowing the wires to bend sharply and immediately. The strain relief sleeve is connected to the electrical cord remotely from the plug body. More importantly, the connection from the plug head and the strain relief sleeve comprises one or more relatively thin rails that do not come into contact with the electrical cord. These rails can be notched alternately on either side with V-shaped notches to increase their flexibility, reduce their weight and reduce the amount of plastic required to form the strain relief assembly. The combination of the unsleeved wires exiting from the plug body and the lightweight, flexible strain relief assembly allows the combination to bend sharply at the exit from the plug body, thereby accommodating closely placed furniture, and reducing or eliminating the tortional force tending to withdraw the plug from the outlet. The plug body is preferably thin to accommodate the rapid bending close to the outlet wall.

In accordance with one feature of the present invention, two rails are used to connect the strain relief sleeve to the plug body, one on each side of the electric cord and in a line parallel to the floor. This configuration enhances the ability of the cord-strain relief sleeve combination to bend near the plug head.

In accordance with another feature of the present invention, the electric cord section between the plug head and the strain relief sleeve includes a small amount of electric cord length in excess of the length of the strain relief structure. This creates slack in the cord which can take up any slippage between the electric cord copper wires and the cord jacket, further protecting the copper wires and power blade connections. In addition, this slack in the electrical cord between the plug body and the remote strain relief connection creates an arc in the electric cord between the plug body and the strain relief sleeve. This arc can be extended in either of two directions between the two side rails, depending on the more relaxed side of the flexible strain relief rails. Any small turn in the exit angle of the cord (such as might be created by the force of gravity) snaps the slack arc in the cord in the opposite direction, creating a force which assists in accentuating the tightness of the turn of the cord close to the outlet wall.

In accordance with another feature of the present invention, a plastic insert is inserted inside of the strain relief assembly to increase the strength of the strain relief assembly, to double insulate the copper wires near the plug body and the connection of the copper wires to the power blades, and to prevent stray exposed wire strands from being molded dose to the outer surface of the plug assembly. A strong, flexible material such as nylon would be suitable for this purpose. The V-shaped grooves in the rails (used to add flexibility) could also be used to position the insert by allowing the insert to be exposed at the vase of the V-shaped grooves and to be positioned by mating grooves in the base of inverted mold grooves.

BRIEF DESCRIPTION OF THE DRAWINGS

A complete understanding of the present invention may be gained by considering the following detailed description in conjunction with the accompanying drawings, in which:

FIG. 1 shows a perspective view of a molded strain relieved electric plug showing the flexible notched rails and remote strain relief sleeve in accordance with the present invention;

FIG. 2 shows a perspective view of the insert inside of the strain relief assembly, shown in dotted form in FIG. 1.

FIG. 3 shows a cross sectional view of the notched rails showing an included plastic insert :for increased strength in accordance with the present invention;

FIG. 4 shows a side view of the electric plug assembly shown in a perspective view in FIG. 1, showing the arc in the electric cord between the plug body and the strain relief sleeve;

To facilitate reader understanding, identical reference numerals are used to designate elements common to the figures.

DETAILED DESCRIPTION

Referring more particularly to FIG. 1, there is shown a perspective view of an electric plug in accordance with the present invention comprising a plug body 10 having a pair of power blades 11 and 12 exiting from the front face thereof and an electric cord 13 exiting from the rear face thereof. Plug body 10 includes a head portion which is preferably thin in a back-to-front direction to minimize the extension of the head of the plug body from a mating wall outlet and wide in a side-to-side direction to facilitate insertion of the plug into the wall socket. The rear surface of the head of plug body 10 includes a protrusion 18 which is used to contain the electrical connections of the blades 11 and 12 to the copper wires supplying electricity from the plug of FIG. 1. The electric plug of FIG. 1 may optionally include a third grounding prong 14 and an extension 19 of protrusion 18 to accommodate the ground prong connection to a grounding wire. The extension 19 of protrusion 18 also assists in orienting the plug properly for insertion into a mating electric outlet having a ground prong socket for prong 14. The electric cord 13 exits from protrusion 18 through a collar 28 which increases the contact area with cord 13 and thus improves the frictional grasp of the molded protrusion 18 on cord 13.

In accordance with the present invention, a strain relief sleeve 15 is located remotely from the plug body 10. That is, strain relief sleeve 15 is displaced away from the back of plug body 10 and is securely attached to cord 13 by the friction caused by the tight fit between cord 13 and sleeve 15. In electric plugs such as that illustrated in FIG. 1, it is desirable to transfer pulling forces on the electric cord 13 to the plug body 10 without permitting these forces to be applied to the entrance of the cord itself to the plug body so that these forces are not applied to the copper wires inside of cord 13 or the connections of the copper wires to power blades 11 and 12. Any excessive forces applied to these parts might break the electrical connection or expose these parts, causing an electrical hazard. The usual prior art approach to this problem is to mold an extended strain relief sleeve onto the rear face of the plug head 10, and to pass the cord 13 through the center of this sleeve. Such a sleeve increases the area of contact of the cord jacket with the plug material, thereby transferring most of the pulling forces on the cord to the plug body. Unfortunately, such an arrangement creates a rather rigid electric plug which extend away from the wall outlet. The weight of this extended plug tends to rotate the power blades out of the outlet sockets, exposing the blades or even pulling the plug out of the socket entirely.

In FIG. 1, the strain relief sleeve 15 is connected to the plug head 10 at protrusion 18 by two side rails 16 and 17. Side rails 16 and 17 have oppositely disposed, alternating V-shaped grooves 20 and 21 molded therein to provide a serpentine path which is very flexibly perpendicular to the V-shaped grooves 20 and 21. The protrusion 18 at the rear of plug body 10 has molded integrally therewith an insert 22, shown in dotted lines in FIG. 1. Insert 22 will be described in more detail in connection with FIG. 2. It will be noted, however, that insert 22 includes two thin strips 23 and 24 extending centrally through rails 16 and 17. Insert 22 is fabricated of a tough, elastic material such as nylon to provide additional strength to the rails 23 and 24. The plug body end of insert 22 includes a box-like enclosure 25 to enclose the electrical connections of the cord 13 to the blades 11 and 12. When integrally molded with the plug assembly of FIG. 1, enclosure 25 provides double insulation of the electrical interconnections within the plug body, improving the safety factor and ensuring that no stray wires from the cord 13 is molded close to the outer surface of the plug body.

Referring more particularly to FIG. 2, there is shown a perspective view of the insert 22 included within the molded flexible remote strain relief plug of FIG. 1. As previously noted, insert 22 includes a head portion 25 for containing the electrical interconnections of the blades 11 and 12 and ground prong 14 to the wires within cord 13. Angled flanges 26 and 27 at the sides of head portion 25 to lock insert 22 into the molded head portion of plug body 10. Rails 23 and 24 are connected at the end remote from head portion 25 by a half-collar 29 to maintain the spacing between rails 23 and 24 and to assist in anchoring cord 13 in strain relief sleeve 15.

In FIG. 3 there is shown a cross sectional view of the molded flexible remote strain relief plug of FIG. 1 in the central region of rails 16 and 17 showing the central location of insert 22 at rails 23 and 24 within flexible rails 16 and 17. The material of insert 22 is a tough, flexible plastic material such as nylon to carry much of the longitudinal strain on the molded plug of FIG. 1.

In FIG. 4 there is shown a side elevation view of the electric plug of FIG. 1 illustrates the manner in which the electric cord 13 includes some slack between the protrusion 18 and the remote strain relief sleeve 15. This slack is created during the molding process by providing a serpentine path for cord 13 in this area, but outside of the mold itself. This slack causes the remote strain relief sleeve 15 to move by snap action between a downward position, shown in FIG. 4, and an upward position if the exit from the wall outlet is in the upward direction. That is, if the free portion of cord 13 is pulled upward, for example by the placement of a tool or appliance above the wall outlet, it will snap into an upward direction under the force created by the slack loop in cord 13 between protrusion 18 and sleeve 15. This snap action ensures that the flexible remote strain relief plug of the present invention will not extend unduly from the wall and become a problem for the placement of furniture in front to the wall outlet.

It can be seen that the remote strain relief electric plug of the present invention allows the construction of a plug which provides adequate strain relief yet does not result in a plug which is substantially inflexible throughout its entire length. In addition, the alternating V-shaped grooves improves flexibility in the vertical plane while the slack in the cord forces the cord to exit at an angle to the horizontal. The insert inside of the molded plug increases strength, protects the electrical connection to the cord wires, and prevents stray wires from migrating to the surface of the mold during the molding process.

What is claimed is:

1. An electric plug comprising a plug body having a first side and an oppositely disposed second side, a plurality of electric power blades held rigidly in position at an exit point on said first side of said plug body for insertion into an electrical outlet, an electric cord having internal conductors surrounded by insulation connected to said plug body at an entrance point on said second side of said plug body, means for connecting said internal conductors of said cord to said electric power blades, a strain relief sleeve attached to said electric cord remotely from said plug body, at least one rail member connected between said plug body and said strain relief sleeve to transfer forces on said cord to said plug body without transferring significant forces to said cord at said entrance point to said plug body, and an internal insert within said rail member of flexible material having tensile strength significantly greater than the tensile strength of said rail member itself.

2. The electric plug according to claim 1 wherein each said rail member further comprises a plurality of alternating V-shaped grooves on opposite sides of said rail member to render said rail member flexible.

3. The electric plug according to claim 1 wherein said cord includes slack in the form of an arc between said plug body and said strain relief sleeve.

4. The electric plug according to claim 1 wherein at least one rail member comprises two rails disposed on opposite sides of said cord connecting said plug body to said strain relief sleeve.

* * * * *

UNITED STATES PATENT AND TRADEMARK OFFICE

CERTIFICATE OF CORRECTION

PATENT NO. : 5,451,171

DATED : September 19, 1995

INVENTOR(S) : Robert G. Dickie

It is certified that error appears in the above-indentified patent and that said Letters Patent is hereby corrected as shown below:

On the Title page, item [73] Assignee, please replace "Raige" with --Paige--.

Signed and Sealed this

Fourteenth Day of May, 1996

Bruce Lehman

*Attest:*

BRUCE LEHMAN

*Attesting Officer*

*Commissioner of Patents and Trademarks*